US006421942B1

(12) United States Patent
Galello

(10) Patent No.: US 6,421,942 B1
(45) Date of Patent: Jul. 23, 2002

(54) PICTURE FRAME

(76) Inventor: Patrick Galello, 1525 S. Cape Verde Rd., Tucson, AZ (US) 85748

( * ) Notice: Subject to any disclaimer, the term of this patent is extended or adjusted under 35 U.S.C. 154(b) by 0 days.

(21) Appl. No.: 09/489,559

(22) Filed: Jan. 19, 2000

Related U.S. Application Data

(60) Provisional application No. 60/117,915, filed on Jan. 29, 1999.

(51) Int. Cl.[7] ..... A47G 1/06
(52) U.S. Cl. ..... 40/738; 40/758
(58) Field of Search ..... 40/738, 729, 750, 40/758, 759

(56) References Cited

U.S. PATENT DOCUMENTS 3,952,437 A * 4/1976 Mitchell ..... 40/152.1
4,196,535 A * 4/1980 Heimo ..... 40/156
4,458,873 A * 7/1984 Sutherland ..... 248/544
4,608,770 A * 9/1986 Gray ..... 40/152
D290,428 S * 6/1987 Johnson ..... D10/301
D407,665 S * 4/1999 Churchville ..... D11/132
5,903,992 A * 5/1999 Eisenberg ..... 40/738
5,921,518 A * 7/1999 Bernardi ..... 248/304
D415,619 S * 10/1999 Gandy ..... D6/301
D424,971 S * 5/2000 Churchville ..... D11/132

* cited by examiner

*Primary Examiner*—Lynne H. Browne
*Assistant Examiner*—Kenn Thompson
(74) *Attorney, Agent, or Firm*—Mark Ogram

(57) ABSTRACT

A picture frame in which the visual impact differs depending on the angle the view has with the frame. The frame is structured to lie in a primary plane and outside of the primary plane. The secondary portion, lying outside of the primary plane, is optionally curved to give an even different impression to the viewer. In one embodiment of the invention, the frame lies in two intersecting planes; in another, three planes; in yet another, four planes. Throughout the differing embodiments, a single envelope is formed which holds the picture within the different sections.

15 Claims, 5 Drawing Sheets

PICTURE FRAME

Priority for this application is claimed from U.S. Provisional Patent application Ser. No. 60/117,915, entitled "Picture Frame" and filed on Jan. 29, 1999, by Galello.

BACKGROUND OF THE INVENTION

This invention relates generally to art and photographs and more particularly to frames used to present the art and photographs.

It is well known within the art world that any picture looks better within a frame. The frame, if properly chosen, creates a "window" for the picture and focuses the attention of the viewer onto the picture itself.

The frame can also be used to set the "mood" or environment for the picture. As example: a smooth metal frame is often chosen for modern shapeless art; finely carved wood is used to accentuate portraits; rough wood is often used to frame Western art.

Except for the choice of frame style and color, there are very few other options available to the artist. In many ways, the artist is totally left out of the framing process. Because of this, the range of artistic endeavor is limited.

It is clear that if more framing options are available for the artist, then the artist is granted a wider range of creations.

SUMMARY OF THE INVENTION

Within the present invention, a picture frame is creates which creates differing visual impacts depending on the angle the view has with the frame. As the viewer moves, the image which is seen appears to change.

To accomplish this affect, within the present invention the frame is structured to lie in a primary plane and outside of the primary plane. As example, for one embodiment of the invention, the two portions of the frame are positioned at right angles to each other. This allows the frame to be placed either within an inside corner or at an outside comer. In the preferred embodiment of this example, both surfaces of the frame are transparent allowing the same frame to be used either at an inside or an outside comer.

In one embodiment, the portion which lies outside the primary plane is curved to give an even different impression to the viewer. The affect of the curve is partially established by the depth or radius of the curve and the image which is contained within the frame.

In another embodiment of the invention, the frame lies in three planes allowing the contained picture or image to "jut" out from the wall.

In yet another embodiment, four planes are used. In this embodiment, the image juts away from the wall and then back to the wall.

Throughout the differing embodiments, a single envelope is formed which holds the picture within the different sections. The image which is contained within the frame is chosen to capitalize upon the differing perspectives made available by the frame and to impact the viewer with the greatest affect.

The present invention creates a frame which escapes from the planar requirements of the traditional frames. In the present invention, the frame, and by extension, the glass covering the art work, is non-planar and is still configured to be mounted or hung from a wall.

In this manner, the frame of this invention expands from the two dimensional world and creates a three dimensional potential for the artist.

An example of the present invention is a frame which "juts out" from the plane to extend into the room and then passes back to the wall plane. This "jutting" aspect of the frame provides for four different planes for the artist to utilize. At any point in the room, all of the planes are not fully visible, thereby allowing the artist to create images which literally change as the viewer passes from point to point within the room.

In another embodiment of the invention, the frame extends around a comer of the room. The frame in this embodiment is ideally suited for an edge so that one image is placed on the first wall while another image is placed on the second wall.

A similar concept is utilized in a comer of a room allowing the decorator and artist to work in concert to add significant variety to a room's comer.

In still other embodiments, the three dimensional extension from the wall is accomplished using curved (as opposed to planar) pieces to create a smooth flowing mosaic.

The invention, together with various embodiments thereof, will be more fully explained by the accompanying drawings and the following description.

DRAWINGS IN BRIEF

DRAWINGS IN DETAIL

Figure 1:
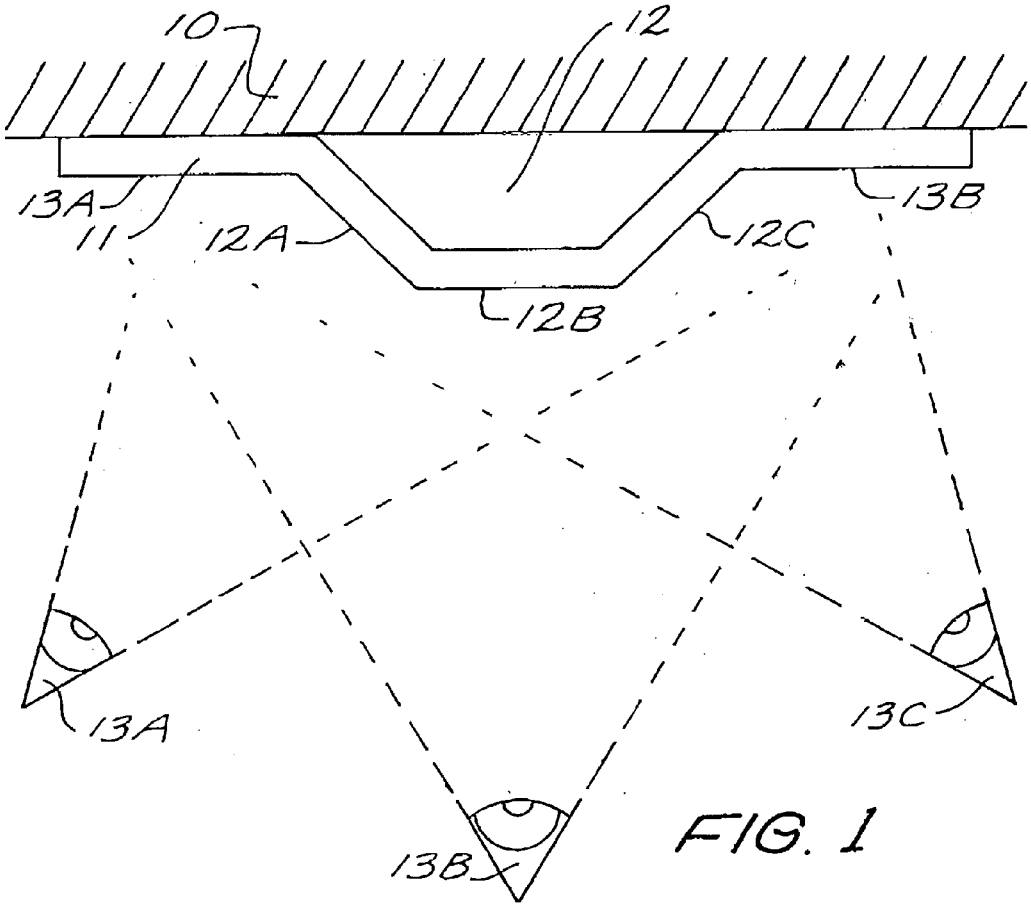
FIG. 1 is a top view of an embodiment of the invention illustrating the changing perceived image as the viewer moves within the room.

FIG. 1 is a top view of an embodiment of the invention illustrating the changing perceived image as the viewer moves within the room.

Frame 11 is secured to wall 10 using traditional means such as wire supports or screws. Frame 11 includes extension member 12. In this embodiment, five separate surfaces are provided for the placement of images (whether seamless or not). These surfaces 13A, 12A, 12B, 12C, and 13B, are available for the artist to create whatever affect the artist chooses.

Once the images are mounted within frame 11, the perceived image changes as the viewer moves throughout the room. The image perceived by viewer 13A captures very little from 12B and nothing or almost nothing from 12C.

The affects of images from 12A and 12C are minimized for viewer 13B. Viewer 13C perceives very little from 12A and only minimally is affected by the image 12B.

Without the frame of this invention, the affect noted above is beyond the artist's ability.

Figure 2:
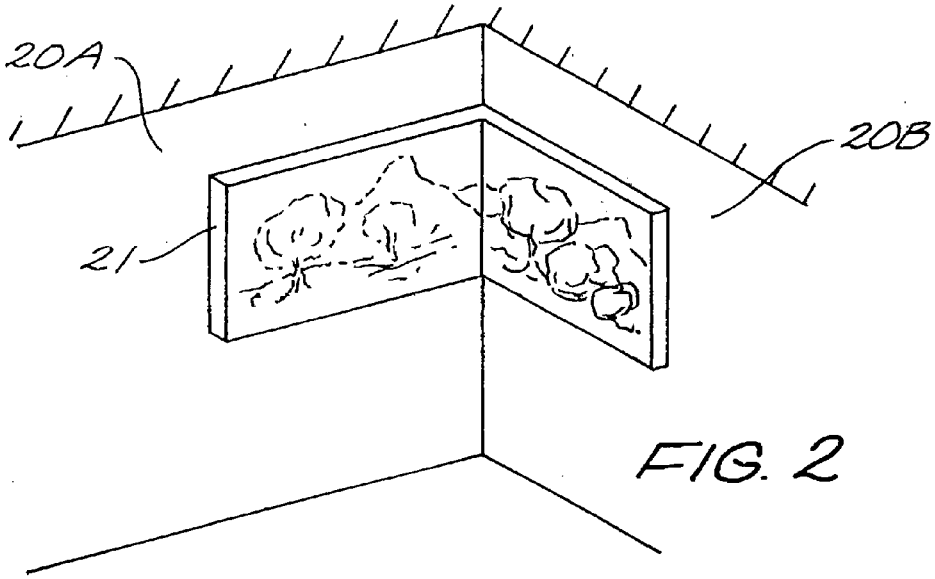
FIG. 2 illustrates an embodiment of the frame which is configured to fit into a comer of a room.

FIG. 2 illustrates an embodiment of the frame which is configured to fit into a corner of a room.

In this embodiment, frame 21 is secured to both walls 20A and 20B. This embodiment is particularly useful to "open" a room by giving depth to a comer.

Figure 3A:
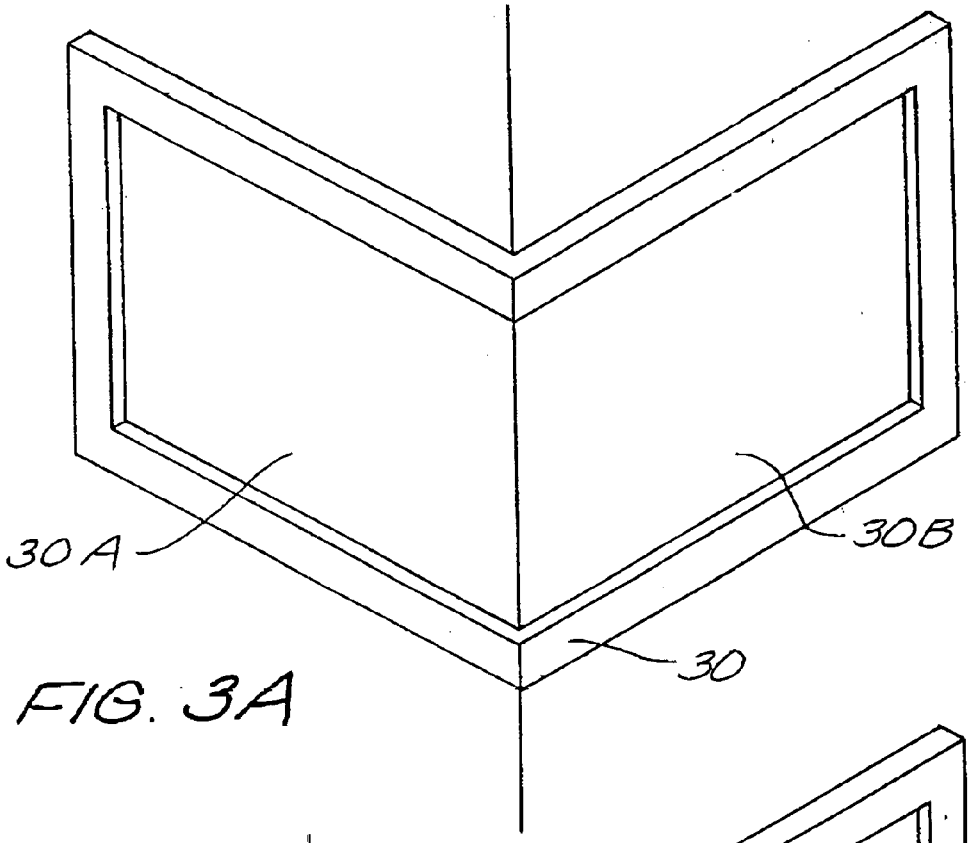
FIG. 3A illustrates an embodiment of the invention used to "wrap around" a comer of a comer of a room.

FIG. 3A illustrates an embodiment of the invention used to "wrap around" a comer of a comer of a room.

Frame 30 has two sections, 30A and 30B. These two sections are constructed at right angles to each other and are made to be mounted to an exposed comer of a room. In this embodiment, sections 30A and 30B are equal in size.

This embodiment, is also used to break the line created by the exposed corner formed by two walls and to add variety to the room's layout.

Figure 3B:
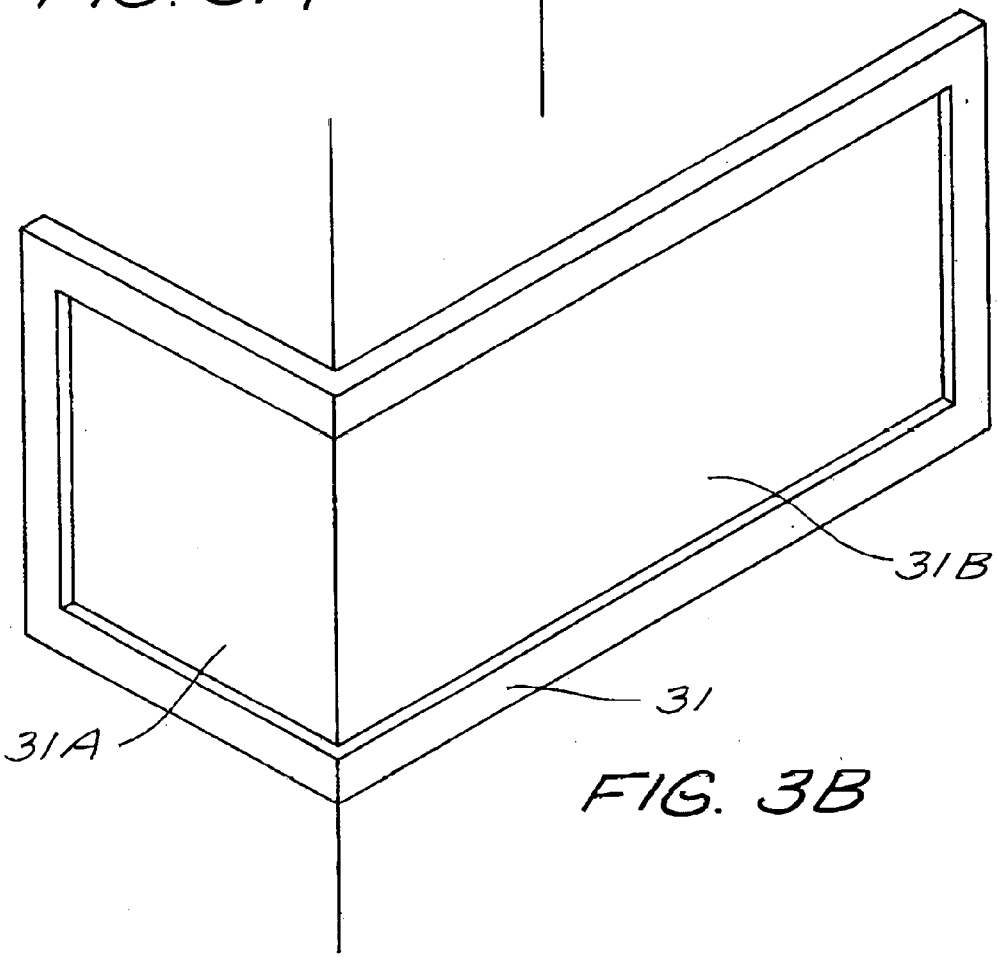
FIG. 3B is an alternative embodiment of that shown in FIG. 3A.

FIG. 3B is an alternative embodiment of that shown in FIG. 3A.

In this embodiment, frame 31 has two sections 31A and 31B which differ in size from each other.

Figure 4:
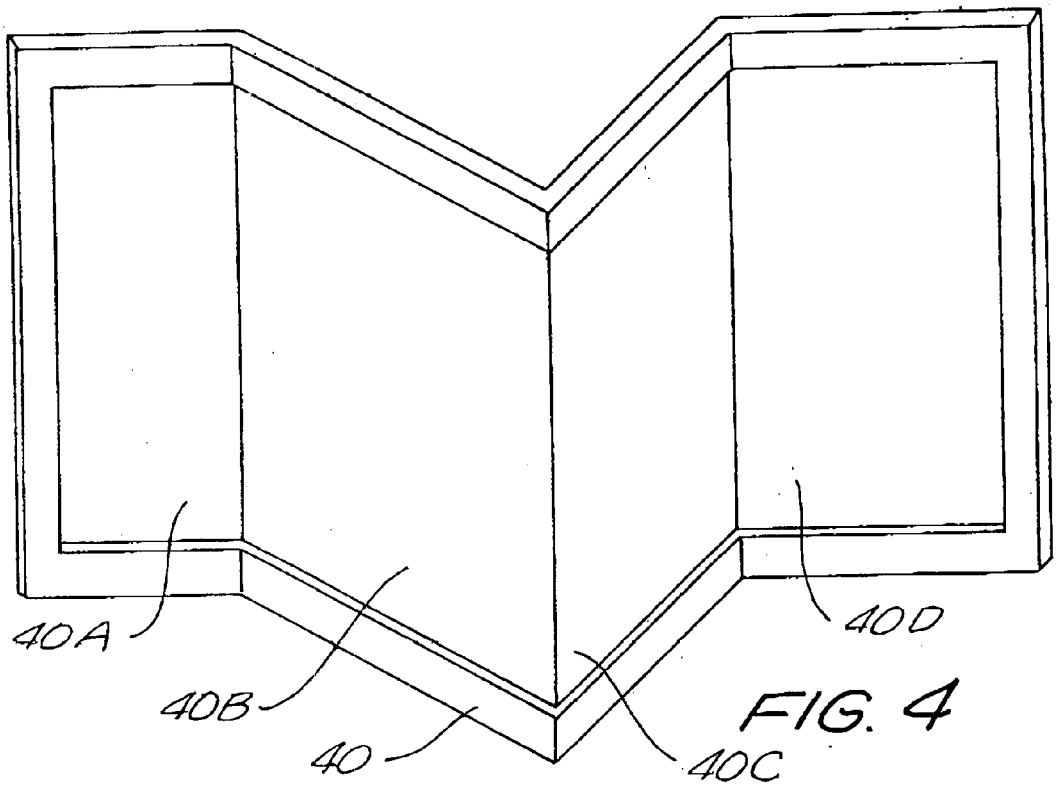
FIG. 4 illustrates an embodiment of the invention which is intended to be mounted on a single wall.

FIG. 4 illustrates an embodiment of the invention which is intended to be mounted on a single wall.

Frame 40 creates four panels (40A, 40B, 40C, and 40D). While frames 40A and 40B are secured to the wall, frames 40B and 40C extend into the room to create the opportunity for the artist to create a three dimensional visual affect upon the viewer.

Figure 5:
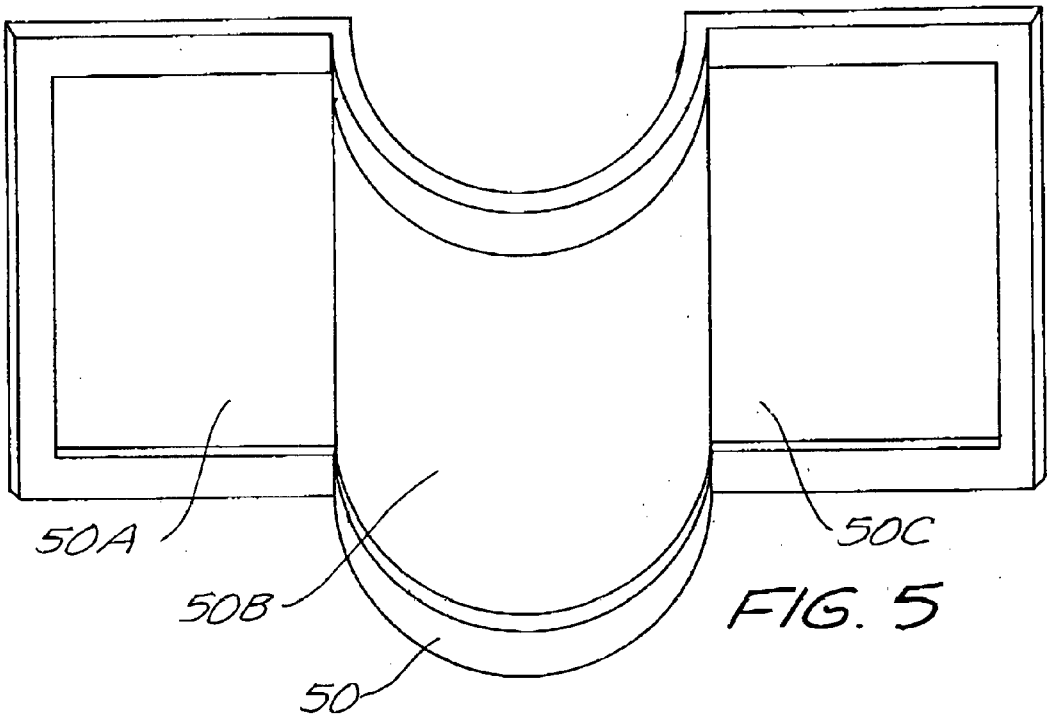
FIG. 5 illustrates another embodiment of the invention which is designed to be secured to a wall and create a curved or continuous feel to the three dimensional aspect of the frame.

FIG. 5 illustrates another embodiment of the invention which is designed to be secured to a wall and create a curved or continuous feel to the three dimensional aspect of the frame.

Frame 50 has two planar panels, 50A and 50C, and a curved panel 50B. Unlike the prior embodiments discussed, a seam in curved panel 50B is not created while the panel creates the three dimensional affect.

Ideally, the panels of the frames of FIGS. 1, 2, 3A, 3B, 4, and 5, are distributed in kits whereby the artist is allowed to choose the size and shape of the varying panels and then create a unique three dimensional frame.

Figure 6:
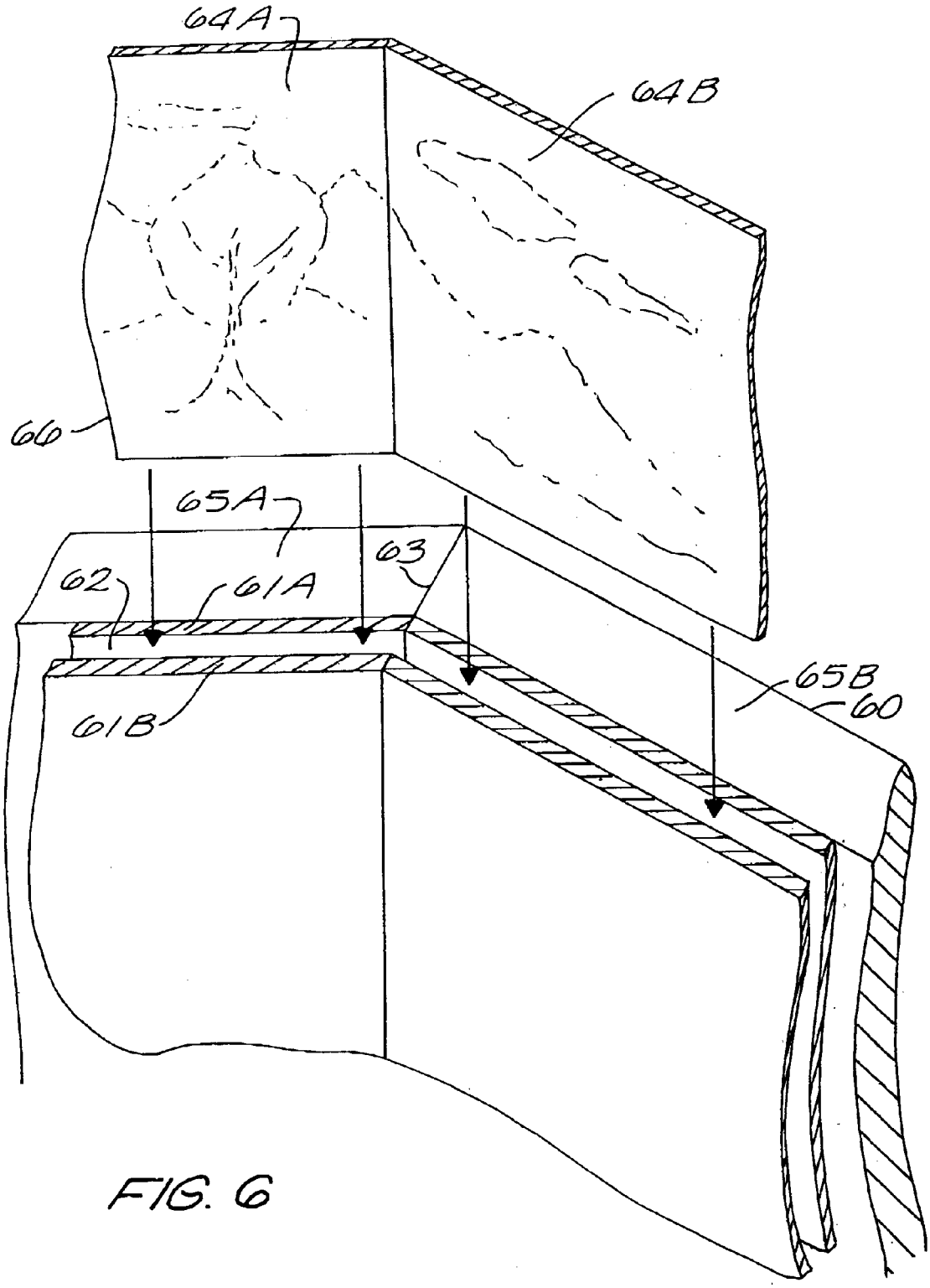
FIG. 6 is a perspective view of an embodiment of the invention showing the image being placed within an embodiment of the invention.

FIG. 6 is a perspective view of an embodiment of the invention showing the image being placed within an embodiment of the invention.

Frame 60, in this embodiment, has a first section 65A and a second section 65B joined at joint 63. Each of the section has a transparent layer 61B with backing 61A forming a continuous envelope 62 which extends through section 65A and section 65B.

Photo or illustration 66 has two portions 64A and 64B. Ideally these two portions are created to form a continuous image which capitalizes upon the invention's perceptional characteristics. When photo 66 is placed within the envelope 62 of frame 60, as illustrated by the arrows, photo portion 64A fits into frame portion 65A while photo portion 64B fits into frame portion 65B. In one embodiment of the invention, an original work of art is encased in envelope 62 of frame 60.

Figure 7:
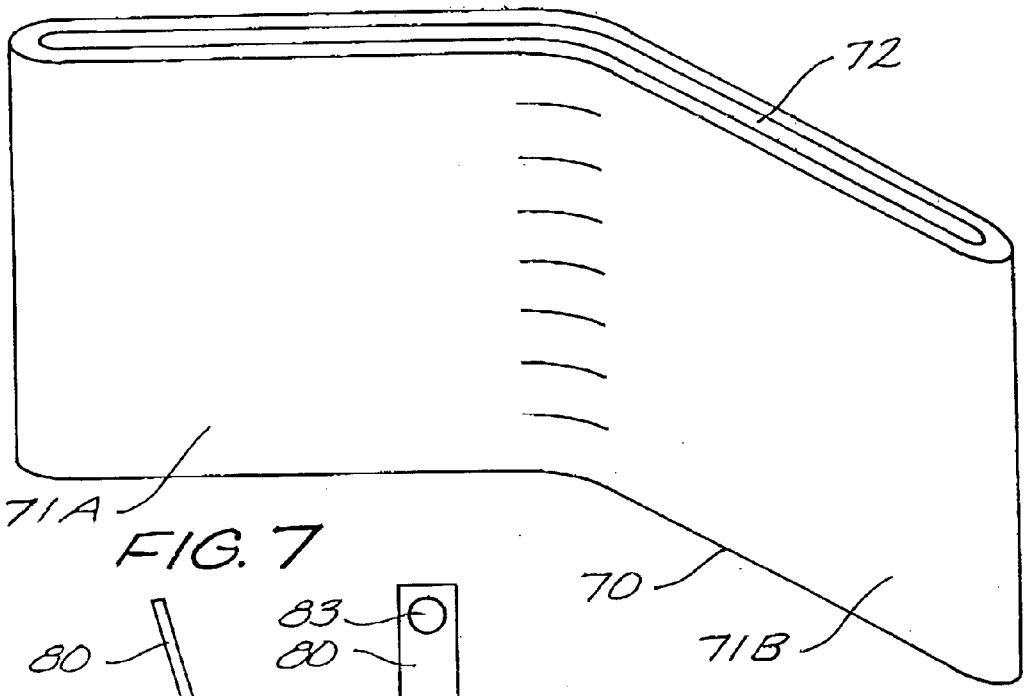
FIG. 7 is a perspective view of an embodiment of the invention in which the entire frame is made from clear or substantially clear material.

FIG. 7 is a perspective view of an embodiment of the invention in which the entire frame is made from clear or substantially clear material.

Frame 70 is made of a substantially clear material. In this embodiment, the entire frame is transparent, providing enhanced viewing capabilities as the enclosed image (not illustrated here) appears to be "free standing". The single photographic or artistic image is placed within envelope 72 allowing the portion of the image within frame portion 71A and the image portion within frame portion 71B to be clearly seen.

As with the other embodiments, depending on where the observer is positioned relative to frame 70, the viewed image differs.

This particular embodiment is ideally used for a standalone frame being at least three feet high and about four feet wide. In this application, a second photographic image is placed so that it is viewable from the "back" panel of frame 70.

The entire frame is either then hung from the ceiling or placed upon the floor for an artistic expression.

Figure 8:
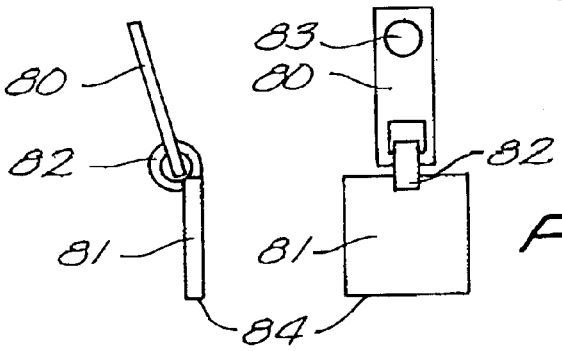
FIG. 8 is a side view of a mechanism used to hang the frame on the wall.

FIG. 8 is a side view of a mechanism used to hang the frame on the wall.

While FIG. 8 illustrates one mechanism which is used to secure or hang the invention to a wall, those of ordinary skill in the art readily recognize a variety of other mechanisms which will serve this function.

Hanger 84 is made up of three sections: anchor plate 81 which is secured to the frame; wall connector 80 which has opening 83 through which a nail (not shown) or screw secured to the wall is placed; and swivel 82 which connects the anchor plate 81 to the wall connector 80.

Wall anchor 81 is secured to the frame using adhesive. The frame is then leveled and the position of the required screws are determined. These screws are then placed into the wall. Opening 83 is then placed around the head of the screw to secure the frame to the wall.

Figure 9A:
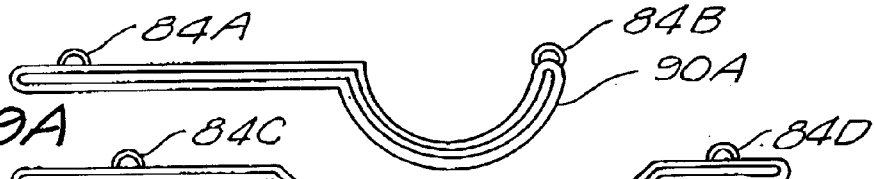
FIGS. 9A and 9B illustrate the placement of the hanging mechanism of the present invention.
Figure 9B:
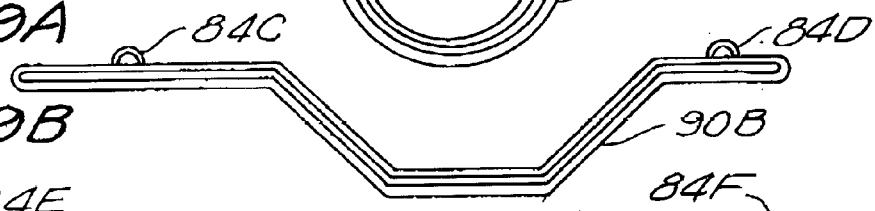

FIGS. 9A and 9B illustrate the placement of the hanging mechanism of the present invention.

In FIG. 9A, frame 90A is secured to the wall using hangers 84A and 84B. In like fashion, frame 90B is secured using hangers 84C and 84D.

Figure 10:
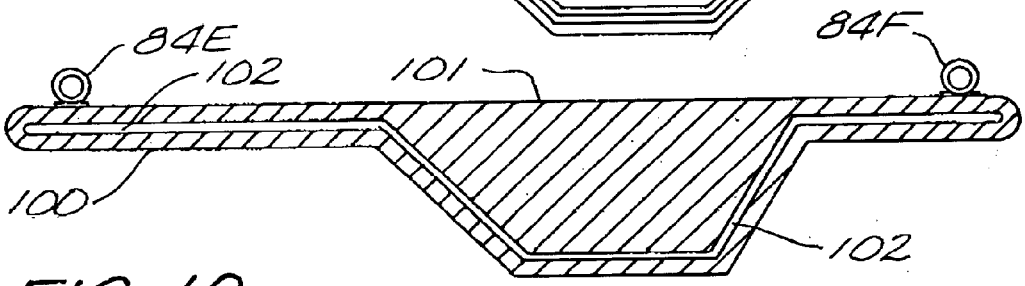
FIG. 10 is a top view of another embodiment of the invention.

FIG. 10 is a top view of another embodiment of the invention.

While many embodiments of this invention are planar in shape, the embodiment of FIG. 10 shows that frame 100 is not planar but achieves the invention's result of creating a continuous envelope 102 therethrough. Note, envelope 102 passes from a primary plane and then back Hangers 84E and 84F are secured on the back side 101 of frame 100. Back side 101 is linear allowing for easier attachment of frame 10 to a wall.

It is clear from the foregoing that the present invention creates a highly unique and versatile frame which greatly expands the range of the artist's creative talents.

What is claimed is:

1. A picture frame comprising a sleeve adapted to hold a single picture therein, said sleeve having a first portion positioned in a first plane, and a second portion positioned in a second plane and extending from said first plane, said sleeve forming a single envelope for securing said single picture in both said first portion and said second portion thereof.

2. The picture frame according to claim 1, wherein said sleeve includes:

a) a third portion positioned within the first plane;

b) a fourth portion connecting said second portion to said third portion; and, wherein said first, second, third, and fourth portions form a continuous envelope adapted to receive said single picture therein.

3. The picture frame according to claim 2, further including:

a) a first hanger secured to the first portion of said sleeve, said first hanger adapted to secure said first portion of said sleeve to a wall; and, b) a second hanger secured to the third portion of said sleeve, said second hanger adapted to secure said third portion of said sleeve to a wall.

4. The picture frame according to claim 1, further including a first hanger adapted to secure said sleeve to a wall.

5.The picture frame according to claims 4, a) wherein said first hanger is secured to said first portion of said sleeve; and, b) further including a second hanger secured to said second portion of said sleeve.

6. A frame comprising:

a) a first sleeve positioned in a first plane; and, b) a second sleeve positioned in a second plane, an envelope of said first sleeve communicating with an envelope of said second sleeve such that a single picture is displayed in said first sleeve and said second sleeve.

7. The frame according to claim 6, further including:

a) a third sleeve positioned within the first plane; and, b) a fourth sleeve connecting said second portion to said third portion; and, wherein envelopes formed by said first, second, third, and fourth are continuous.

8. The frame according to claim 7, further including a) a first hanger secured to the first sleeve, said first hanger adapted to secure said first sleeve to a wall; and, b) a second hanger secured to the third sleeve, said second hanger adapted to secure said third sleeve to a wall.

9. The frame according to claim 6, further including a first hanger adapted to secure said frame to a wall.

10. The picture frame according to claim 9, a) wherein said first hanger is secured to said first sleeve; and, b) further including a second hanger secured to said second sleeve.

11. A picture frame combination comprising:

a) a sleeve having a first portion positioned in a first plane, and a second portion positioned in a second plane and extending from said first plane, said sleeve forming a single envelope; and, b) a single image contained with said single envelope.

12. The picture frame combination according to claim 11, wherein said sleeve includes:

a) a third portion positioned within the first plane;

b) a fourth portion connecting said second portion to said third portion; and, wherein said first, second, third, and fourth portions form a continuous envelope adapted to receive said single image therein.

13. The picture frame combination according to claim 12, further including:

a) a first hanger secured to the first portion of said sleeve, said first hanger adapted to secure said first portion of said sleeve to a wall; and, b) a second hanger secured to the third portion of said sleeve, said second hanger adapted to secure said third portion of said sleeve to a wall.

14. The picture frame according to claim 11, further including a first hanger adapted to secure said sleeve to a wall.

15. The picture frame according to claim 14, a) wherein said first hanger is secured to said first portion of said sleeve; and, b) further including a second hanger secured to said second portion of said sleeve.

* * * * *